US011096846B2

(12) United States Patent
Bach Castillo

(10) Patent No.: US 11,096,846 B2
(45) Date of Patent: Aug. 24, 2021

(54) AUXILIARY FRAME SYSTEMS FOR WHEELCHAIRS

(71) Applicant: Batec Mobility, S.L., Sant Quirze del Vallès (ES)

(72) Inventor: Pablo Alejandro Bach Castillo, Sant Cugat del Valles (ES)

(73) Assignee: Batec Mobility, S.L., Barcelona (ES)

( * ) Notice: Subject to any disclaimer, the term of this patent is extended or adjusted under 35 U.S.C. 154(b) by 388 days.

(21) Appl. No.: 16/273,173

(22) Filed: Feb. 12, 2019

(65) Prior Publication Data

US 2019/0247251 A1 Aug. 15, 2019

(30) Foreign Application Priority Data

Feb. 14, 2018 (EP) ..... 18382083

(51) Int. Cl.
*A61G 5/10* (2006.01)
*A61G 5/02* (2006.01)
*A61G 5/08* (2006.01)

(52) U.S. Cl.
CPC ..... *A61G 5/1083* (2016.11); *A61G 5/1078* (2016.11); *A61G 5/02* (2013.01);
(Continued)

(58) Field of Classification Search
CPC ..... A61G 5/1083; A61G 5/02; A61G 5/1078; A61G 5/1097
(Continued)

(56) References Cited

U.S. PATENT DOCUMENTS 4,310,167 A * 1/1982 McLaurin ..... A61G 5/00 280/250.1
5,011,175 A 4/1991 Nicholson et al.
(Continued)

FOREIGN PATENT DOCUMENTS

DE 4000706 A1 * 7/1991 ..... A61G 5/02
DE 19933053 A1 * 2/2001 ..... A61G 5/046
(Continued)

OTHER PUBLICATIONS

European Search Report dated Jul. 25, 2018 From the European Patent Office Re. Application No. 18382083.6. (5 Pages).

*Primary Examiner* — Ruth Ilan
*Assistant Examiner* — Myles A Harris

(57) ABSTRACT

An auxiliary frame system for a wheelchair, the wheelchair having a frame comprising two openings to releasably attach axle portions of rear wheels and defining between them a main rear wheel axis; wherein the auxiliary frame system comprises: a pair of wheel displacing elements; fastening elements to releasably attach each wheel displacing element to the frame of the wheelchair through the openings; wheel holders for bearing respective rear wheels of the wheelchair, wherein each of the wheel holders is associated with a respective wheel displacing element, and the wheel holders define between them a shifted rear wheel axis; at least one anchoring link to releasably secure at least one of the wheel displacing elements to the frame of the wheelchair at an additional attachment point. Also provided are wheelchairs comprising such auxiliary frame system and methods to displace the position of rear wheels of a wheelchair.

15 Claims, 7 Drawing Sheets

(52) U.S. Cl.
CPC ..... *A61G 5/0875* (2016.11); *A61G 5/0891* (2016.11); *A61G 5/1054* (2016.11)

(58) Field of Classification Search
USPC ..... 280/304.1
See application file for complete search history.

(56) References Cited

U.S. PATENT DOCUMENTS 5,351,774 A * 10/1994 Okamoto ..... A61G 5/047 180/11
5,480,172 A * 1/1996 James ..... A61G 5/00 280/250.1
5,575,348 A * 11/1996 Goertzen ..... A61G 5/045 180/65.6
5,727,802 A * 3/1998 Garven, Jr. ..... A61G 5/08 280/250.1
6,079,725 A * 6/2000 Lazaros ..... A61G 5/08 188/301
6,161,856 A * 12/2000 Peterson ..... A61G 5/1062 280/250.1
6,168,178 B1 * 1/2001 Garven, Jr. ..... A61G 5/08 280/250.1
7,464,949 B1 * 12/2008 Downey ..... A61G 5/10 280/149.2
7,871,094 B2 * 1/2011 Balcom ..... A61G 5/1075 280/250.1
8,016,310 B2 * 9/2011 Kylstra ..... A61G 5/023 280/250.1
2003/0034635 A1 * 2/2003 Ludovici ..... A61G 5/1097 280/647
2004/0150204 A1 * 8/2004 Goertzen ..... A61G 5/06 280/755
2006/0055143 A1 * 3/2006 Schreiber ..... A61G 5/1078 280/250.1
2006/0087103 A1 * 4/2006 Schreiber ..... A61G 5/1054 280/649
2010/0117328 A1 * 5/2010 Johnson ..... A61G 5/045 280/250.1
2010/0123296 A1 5/2010 Chelgren
2012/0013098 A1 * 1/2012 Hart ..... A61G 5/06 280/250.1
2016/0262963 A1 * 9/2016 Morris ..... A61G 5/1078

FOREIGN PATENT DOCUMENTS

EP 3120818 1/2017
FR 2685866 A1 * 7/1993 ..... A61G 5/1078
WO WO-9619961 A1 * 7/1996 ..... A61G 5/1054
WO WO 2006/012699 2/2006
WO WO-2006047343 A2 * 5/2006 ..... A61G 5/1054
WO WO 2015/004298 1/2015
WO WO-2020141843 A1 * 7/2020 ..... A61G 5/12

* cited by examiner

AUXILIARY FRAME SYSTEMS FOR WHEELCHAIRS

RELATED APPLICATION

This application claims the benefit of priority of European Patent Application No. EP18382083.6 filed Feb. 14, 2018, the contents of which are incorporated herein by reference in their entirety.

FIELD AND BACKGROUND OF THE INVENTION

The present disclosure is related to auxiliary frame systems, particularly auxiliary frame systems for wheelchairs. The present disclosure further relates to wheelchairs comprising such auxiliary frame systems and methods to displace the position of rear wheels of a wheelchair.

Wheelchairs are commonly used for the transportation of people with reduced mobility. There is a huge variety of models which may differ in shape, size, etc.

Although common wheelchairs can be successfully used in most circumstances, a number of solutions have been developed to provide known wheelchairs with an enhanced range of use.

One example is embodied by those devices equipped with quick-release systems to allow a rapid release of wheels without using tools, for instance wheels for a general use or wheels for a particular use such as road or mountain. These quick-release systems are commonly used owing to, inter alia, their convenience, easy operation and speed.

Further examples are the so-called hand-bikes which enable the conversion of a traditional wheelchair into a chair in the manner of a tricycle, with the advantages inherent to its features, in a simple and practical way for the user. International application WO2015004298A1 in the name of the present applicant discloses an exemplary embodiment of a hand-bike.

Those hand-bikes may allow the users to use their wheelchair in outdoor environments. However, these outdoor environments may imply the use of the wheelchairs at relatively high speeds, slopes, bends, etc. which means harder requirements than those related to the common use in indoor environment. These harder requirements mean a need for a greater stability and traction capability.

WO2006012699 A1 discloses a dual mode wheelchair providing both a manoeuvrable indoor mode and a travel mode. The wheelbase between fore and rear axis is alterable between a short wheelbase for the manoeuvrable mode and a long wheelbase for the travel mode of the wheelchair.

U.S. Pat. No. 5,011,175 A describes a wheelchair movable between an upper normal sitting position and a lower reclining position. When in the lower position, the seat frame of the wheelchair is located substantially two-thirds nearer the floor or other supportive surface when compared to the upper position.

In WO2006012699 A1 and U.S. Pat. No. 5,011,175 A, wheelchairs with special constructions are described. Those special constructions are characterized by cumbersome solutions which are consequently expensive.

With those known solutions the user cannot adapt and use his/her conventional wheelchair. He/she must acquire a new wheelchair with such a special construction.

It is an object of the present disclosure to provide examples of systems that avoid or at least reduce one or more of the afore-mentioned drawbacks.

SUMMARY OF THE INVENTION

In a first aspect, an auxiliary frame system is provided for a wheelchair that has a frame comprising two openings to releasably attach axle portions of rear wheels and defining between them a main rear wheel axis; wherein the auxiliary frame system comprises: a pair of wheel displacing elements; fastening elements to releasably attach each wheel displacing element to the frame of the wheelchair through the openings; wheel holders for bearing respective rear wheels of the wheelchair, wherein each of the wheel holders is associated with a respective wheel displacing element, and the wheel holders define a shifted rear wheel axis between them; at least one anchoring link to releasably secure at least one of the wheel displacing elements to the frame of the wheelchair at an additional attachment point.

According to this aspect, an auxiliary frame system releasably attachable to a conventional wheelchair through the openings of the frame is obtained.

Thanks to these features, the user can still adapt and use his/her conventional wheelchair and does not need to acquire a new one like the prior-art solutions.

An auxiliary frame system is obtained that may promote stability of the wheelchair in an outdoor environment because the distance between a front part of the frame of the wheelchair and rear wheels and/or the wheel-track distance between the rear wheels are enlarged. The latter is even more important when a hand-bike is attached to the wheelchair. An enhanced stability means improved safety and comfort.

Additionally, this first aspect provides an improved traction capability of the wheelchair with a hand-bike due to the above cited enlarged distances.

This auxiliary frame system also shows a simple construction in comparison with the known solutions.

The auxiliary frame system according to the first aspect does not require the intervention of an installer for its installation in a conventional wheelchair.

Furthermore, a connection of the auxiliary frame system to the frame of wheelchair may take advantage of a quick-release mechanism. The anchoring link provides an additional attachment point between the auxiliary frame system and the frame of the wheelchair. This avoids any relative movement between them, so a reliable coupling between the auxiliary frame system and the frame of the wheelchair is obtained.

In one example, the auxiliary frame system may further comprise: a crossbar to associate the wheel displacement elements with each other; wherein the anchoring link may be connected to the crossbar so as to releasably secure the wheel displacement elements to the frame of the wheelchair at the additional attachment point.

In some examples, the crossbar of the auxiliary frame system may comprise a beam; and the wheel displacement elements may comprise a pair of arms attached to the beam in such a way that the arms may be movable along the beam. This way, this example of auxiliary frame system may be regulated to fit the width of the wheelchair, particularly the distance between the openings of the frame, thus showing a great flexibility that allows adapting it to a huge number of known wheelchairs.

In further examples, the anchoring link may comprise a bar portion which may be attached to the crossbar at different positions to adjust the distance between a hook of the anchoring link and the fastening elements. Thanks to this feature, the auxiliary frame system according to these examples may be regulated in a longitudinal direction so as to match the corresponding distance of the frame of the wheelchair. Thus the auxiliary frame system is even more adaptable.

In a further aspect, the present disclosure provides a wheelchair comprising an auxiliary frame system according to any of herein disclosed examples, wherein the shifted rear wheel axis defined between the wheel holders of the auxiliary frame system is further away from a front part of the wheelchair than the main rear wheel axis of the frame.

In some examples of the wheelchair, the shape of the anchoring link may allow a space to be defined between the auxiliary frame system and a seat of the wheelchair.

In an additional aspect, the present disclosure provides a method to displace the position of rear wheels of a wheelchair, which comprises: removing rear wheels from a frame of the wheelchair; attaching an auxiliary frame system, according to any of the herein disclosed examples, to the frame of the wheelchair; and mounting rear wheels to the auxiliary frame system.

Throughout the present disclosure, expressions such as above, below, beneath, under, upper, lower, bottom, front, fore, front side, rear, longitudinal, transversal, vertical, horizontal, backside, backwards, forwards, etc. are to be understood from the point of view or reference of a user on the wheelchair in a normal operating condition.

BRIEF DESCRIPTION OF THE SEVERAL VIEWS OF THE DRAWINGS

Non-limiting examples of the present disclosure will be described in the following, with reference to the appended drawings, in which.

DESCRIPTION OF SPECIFIC EMBODIMENTS OF THE INVENTION

In attached figures the same reference signs have been used to designate similar elements in different figures. Some parts have not been illustrated for the sake of clarity.

Also for an enhanced comprehension of the present disclosure, a direction of movement of a wheelchair will be illustrated in the attached figures as a dotted line or axis in an exemplary direction followed by a wheelchair when it moves forwards. This direction of movement DM will be illustrated under the wheelchair and between the rear wheels.

Figure 1:
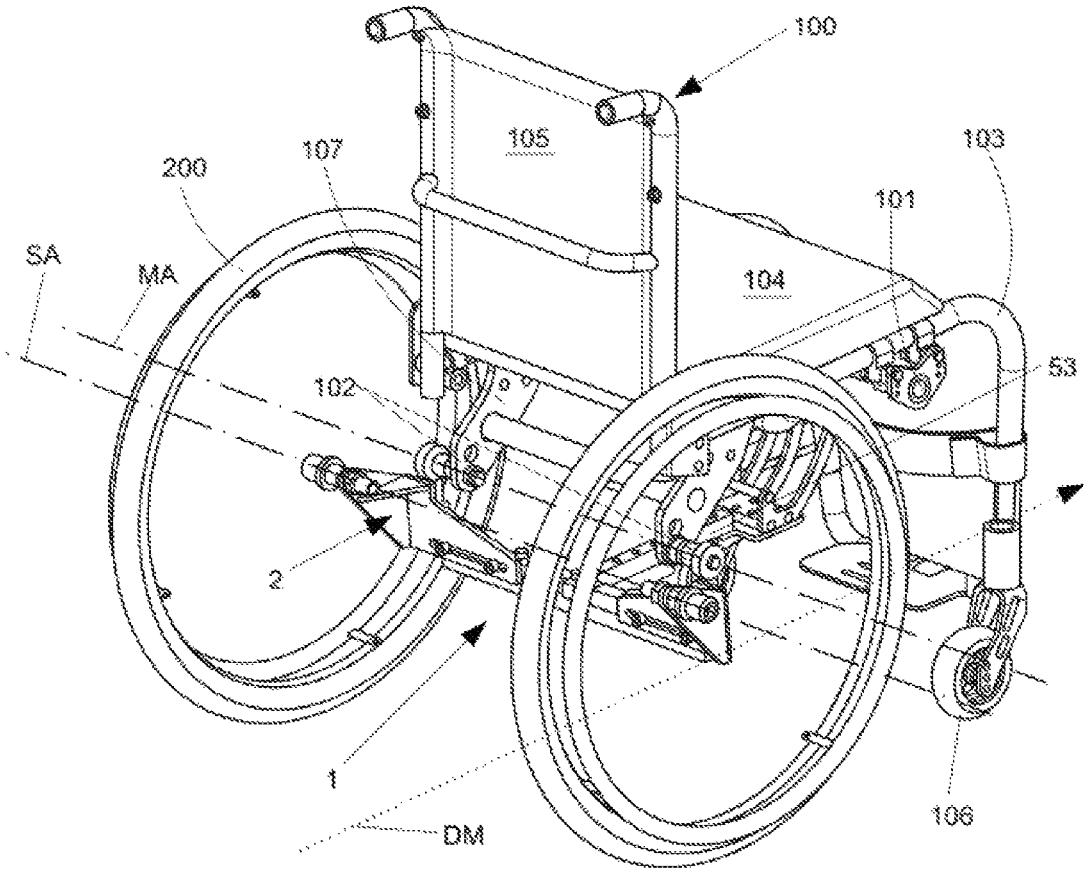
FIG. 1 schematically shows a view in perspective of a wheelchair with an auxiliary frame system according to one example.

FIG. 1 schematically shows a view in perspective of a wheelchair 100 with an auxiliary frame system 1 according to one example. The auxiliary frame system 1 of the attached figures may be detachably coupled to the wheelchair 100 as will be explained later on. The wheelchair 100 may be one having a frame 103 which comprises two openings 102 to releasably attach axle portions of rear wheels 200. The number and shape of openings 102 may vary but in any case they correspond to passageways, holes, borers or the like which are commonly envisaged to receive releasable axle portions of the rear wheels 200. The openings 102 may be arranged in respective plates 107 of the frame 103 (see FIGS. 1 and 11). As those openings 102 are known in the art no further explanation will be provided about them.

In this example of FIG. 1, the releasable axle portions of the rear wheels 200 are not present since the auxiliary frame 1 is coupled to the wheelchair 100 using those openings 102.

The two openings 102 define a main rear wheel axis MA between them. The main rear wheel axis MA is the axis of rotation for the rear wheels 200 when they are mounted to the wheelchair 100 in the normal position, i.e. with their releasable axle portions in the openings 102 (as for example in FIG. 9).

Figure 7:
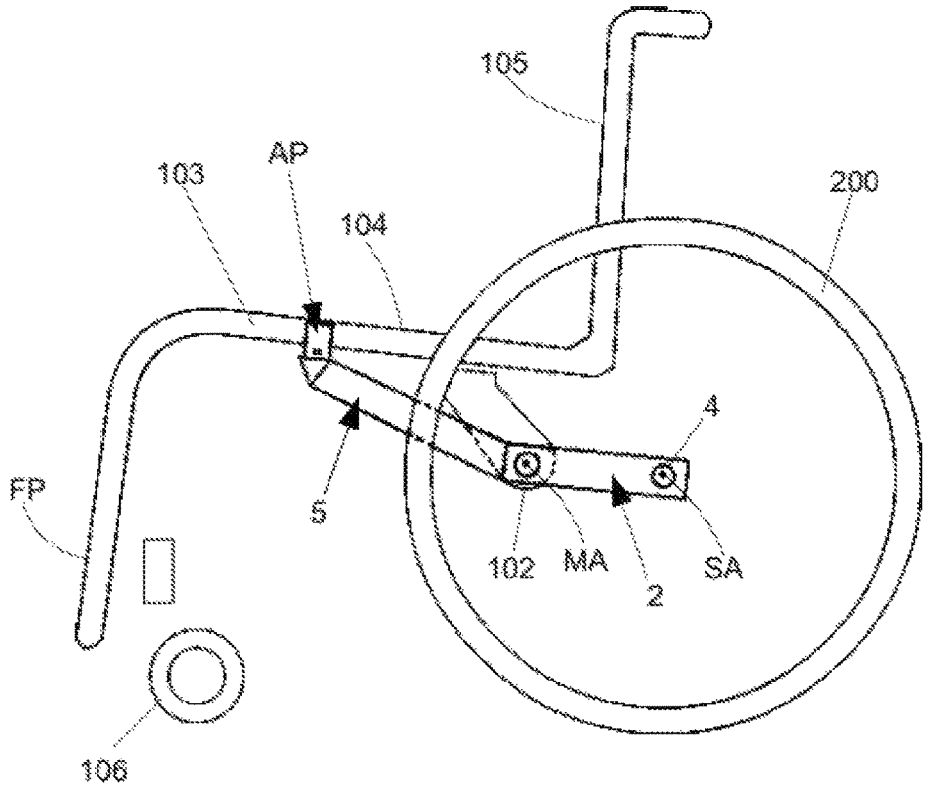
FIG. 7 schematically shows a side view of a wheelchair with the auxiliary frame system according to another example.
Figure 8:
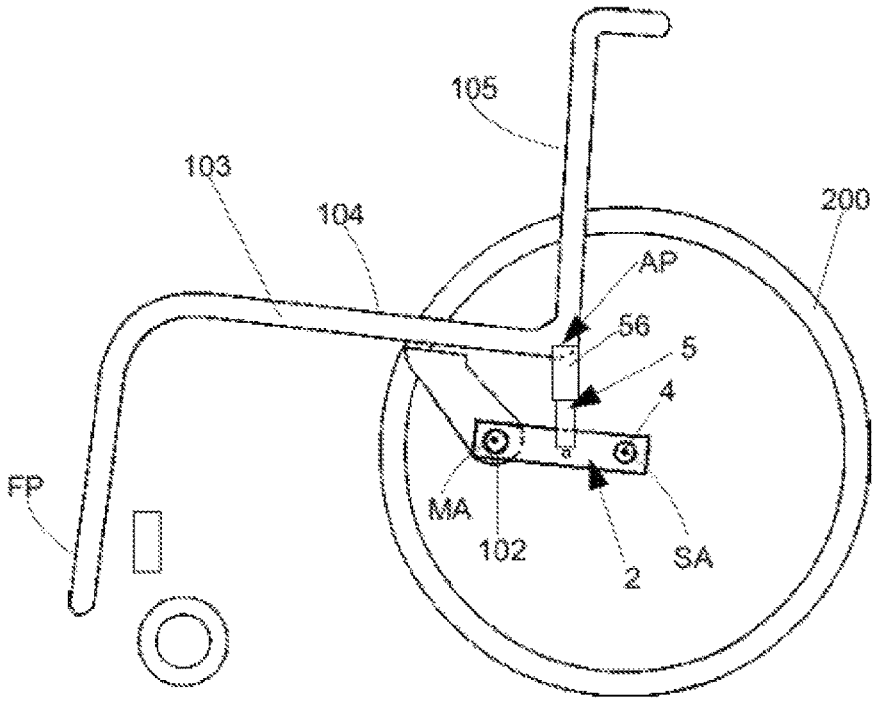
FIG. 8 schematically shows a side view of a wheelchair with the auxiliary frame system according to a further example.
Figure 9:
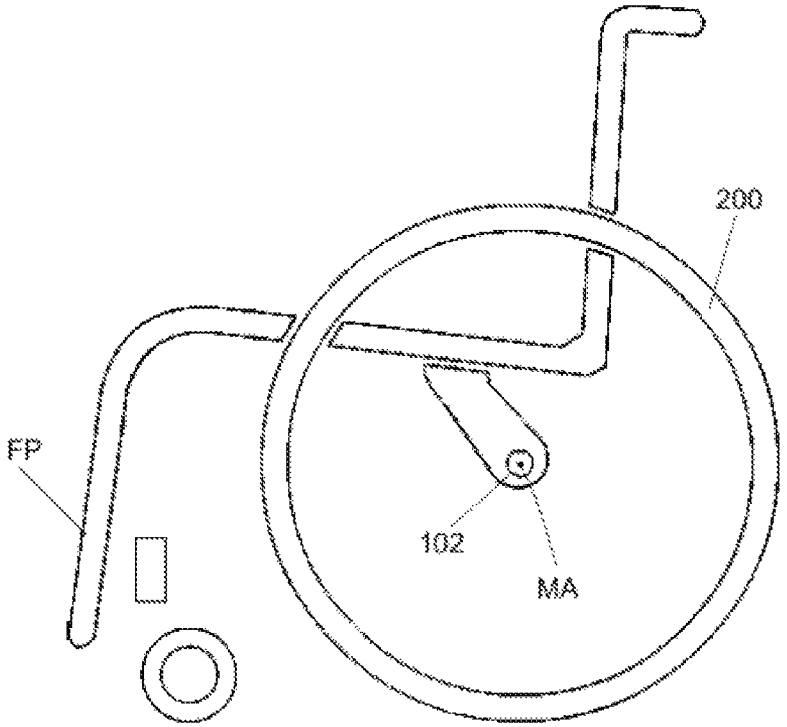
FIG. 9 schematically shows a side view of a wheelchair without the auxiliary frame system wherein rear wheels are set in a main rear wheel axis.

It will be noted here that for a better understanding, a brief description of the exemplary wheelchair 100 illustrated in FIGS. 1, 2, 6, 7, 8, 9, 10 and 11 will be set forth. The wheelchair 100 comprises a seat 104, a backrest element 105, a pair of front wheels 106 at the front part FP of the wheelchair, and a supporting frame 103. In FIG. 9 the wheelchair 100 has been illustrated with rear wheels 200 directly mounted to the frame 103. The rear wheels 200 that are attached to the auxiliary frame 1 may be the same as those usually mounted to a known wheelchair 100, or a different pair of wheels. For instance, the size or purpose of the wheels 200 attached to the auxiliary frame system may differ from those of the wheels that are mounted to the wheelchair 100 in normal daily use.

If the front wheels 106 are a pair of caster wheels, a fore axis may be that one defined between the pivot joints of the caster wheels to the frame 103 (at the front part FP).

In the examples of the auxiliary frame system 1 illustrated in FIGS. 1-11, the auxiliary frame system 1 comprises:

- a pair of wheel displacing elements 2, which are shown positioned under the level of the seat 104 of the wheelchair 100 but substantially displaced backwards with respect to the main rear wheel axis MA. Alternatively, the wheel displacing elements 2 could be positioned slightly forwards from that position of FIG. 1 or 11, relative to the main rear wheel axis MA;
- fastening elements 3 to releasably attach each wheel displacing element 2 to the frame 103 of the wheelchair 100 through the opening 102. In the illustrated examples, there is one fastening element 3 for each wheel displacing element 2, engaging the respective opening 102;
- wheel holders 4 for bearing respective rear wheels 200 of the wheelchair 100, wherein each of the wheel holders 4 may be associated with a respective wheel displacing element 2. The wheel holders 4 define a shifted rear wheel axis SA between them as clearly seen in FIG. 1.

Figure 10:
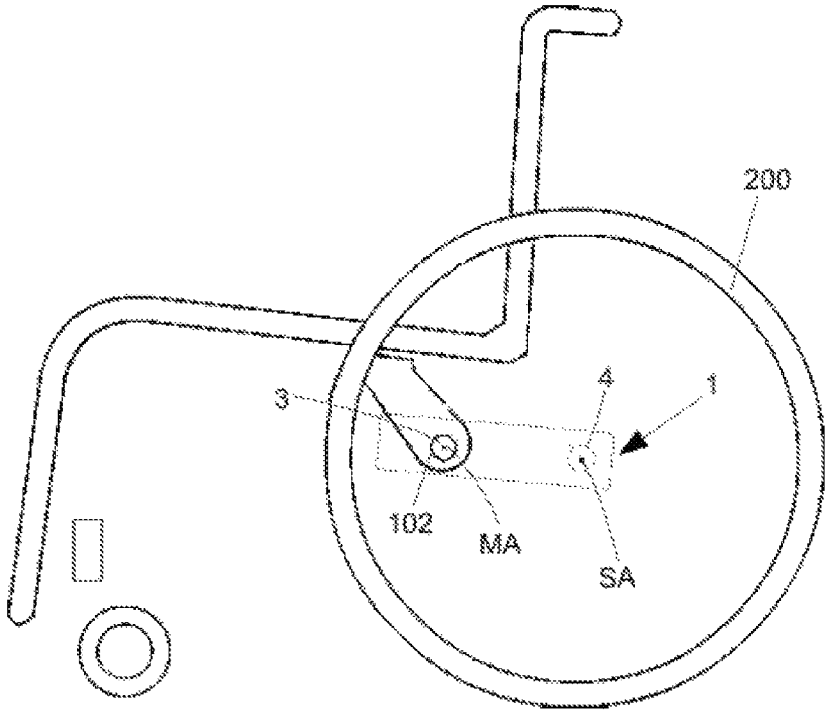
FIG. 10 schematically shows a side view of a wheelchair wherein rear wheels are set in a shifted rear wheel axis.
Figure 11:
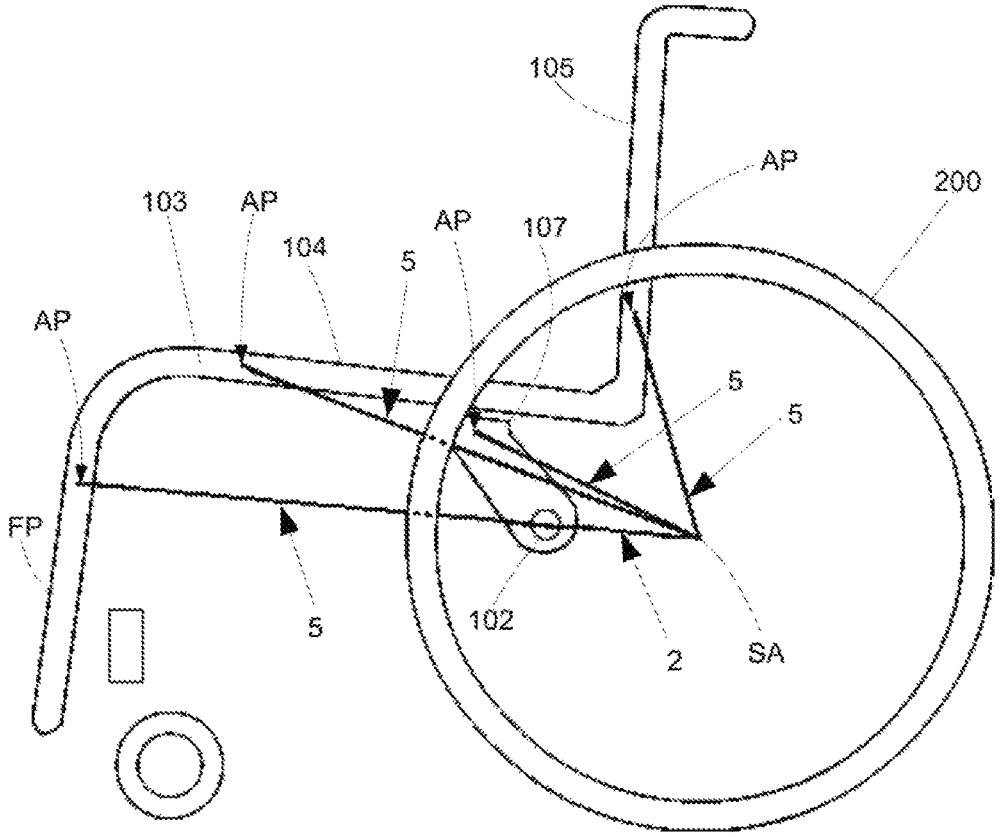
FIG. 11 schematically shows a side view of a wheelchair with the auxiliary frame system arranged according to various examples.

In FIGS. 10 and 11 the shifted rear wheel axis SA is shown as a dot because both figures are side views and the axis is perpendicular to the figure;

at least one anchoring link 5 to releasably secure at least one of the wheel displacing elements 2 to the frame 103 of the wheelchair 100 at an additional attachment point AP. This anchoring link 5 may be adjustable in length so as to adjust the auxiliary frame system 1 in a movement direction MD. The attachment point AP may have different arrangements that will be set forth in the following in relation with FIG. 2, 7, 8 or 11.

Openings 102 to which axle portions of rear wheels 200 are usually connected are conceived and manufactured to bear significant stresses. Therefore, these openings 102 may be the appropriate parts for attaching the fastening elements 3. The openings 102 may offer a resistant and reliable fastening region.

In some examples, the auxiliary frame system 1 may comprise two anchoring links 5 to releasably secure each of the wheel displacing elements 2 to the frame 103 of the wheelchair 100 at the respective additional attachment point AP. These examples are illustrated in FIGS. 7, 8 and 11 and will be detailed later.

In some other examples illustrated in FIGS. 1-6, the auxiliary frame system 1 may further comprise a crossbar 25 to associate the wheel displacing elements 2 with each other. In FIGS. 1 to 6, the crossbar is positioned under the level of the seat 104 and displaced backwards with respect the main rear wheel axis MA. However, the crossbar 5 may be positioned forwards relative to the main rear wheel axis MA in alternative examples. Details of crossbar 25 will be provided later.

The anchoring link 5 may be connected to the crossbar 25 so as to releasably secure the wheel displacing elements 2 to the frame 103 of the wheelchair 100 at the additional attachment point AP.

As mentioned above, the wheel holder 4 is associated with the wheel displacing element 2, for instance the wheel holder 4 may be fixedly attached to the wheel displacing element 2, or the wheel holder 4 may be attached to the wheel displacing element 2 through an additional element, such as a suspension system.

In some examples, at least the wheel holders 4 or the fastening elements 3 may comprise a quick-release mechanism. The quick-release mechanism is based on a known technology which allows a fast change of a wheel, for instance. This way, wheel holders 4 and/or fastening elements 3 can take advantage of a quick-release construction.

In some examples of the auxiliary frame system 1, the crossbar 25 may comprise a beam 21, and the wheel displacing elements 2 may each comprise an arm 22 which may be attached to the beam 21 in such a way that the arms 22 may be movable and fixed in different positions along the beam 21. In this illustrated example, each arm 22 bears a corresponding wheel holder 4.

Figure 2:
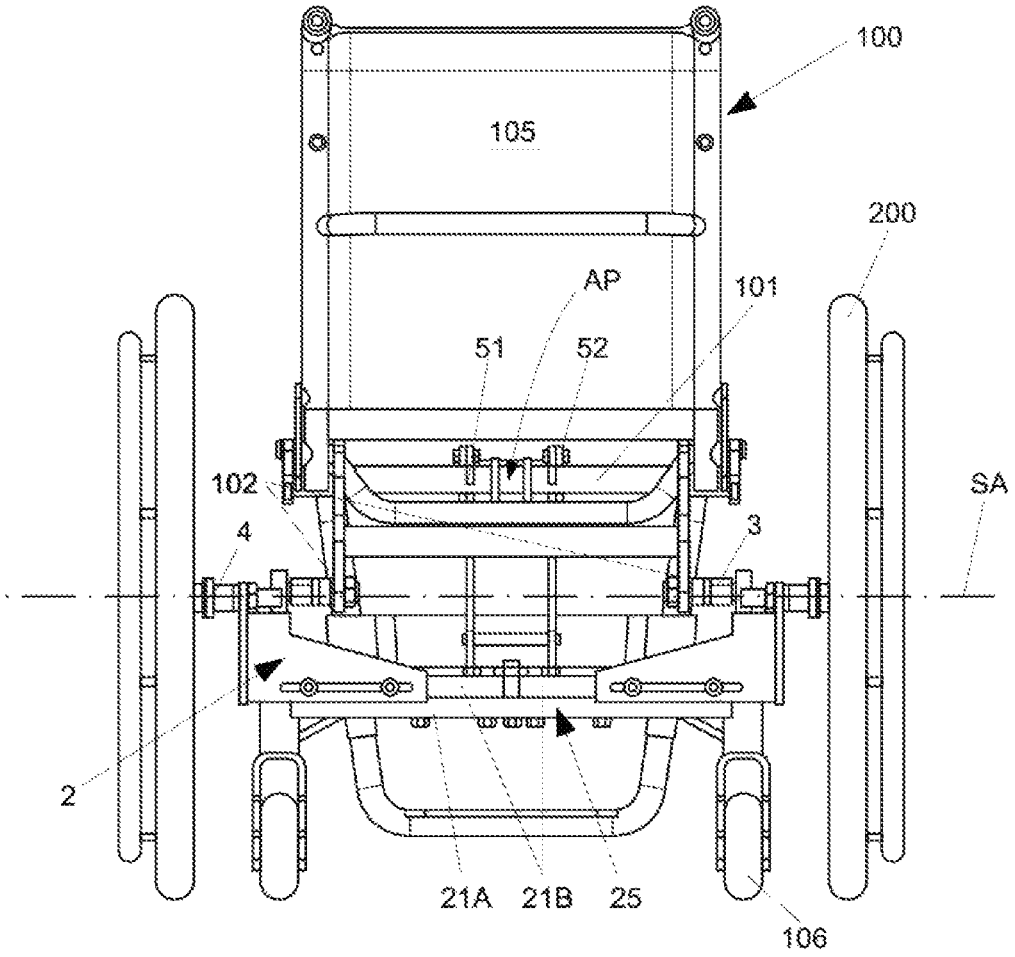
FIG. 2 schematically shows a rear view of the wheelchair of the FIG. 1 with the auxiliary frame.
Figure 3:
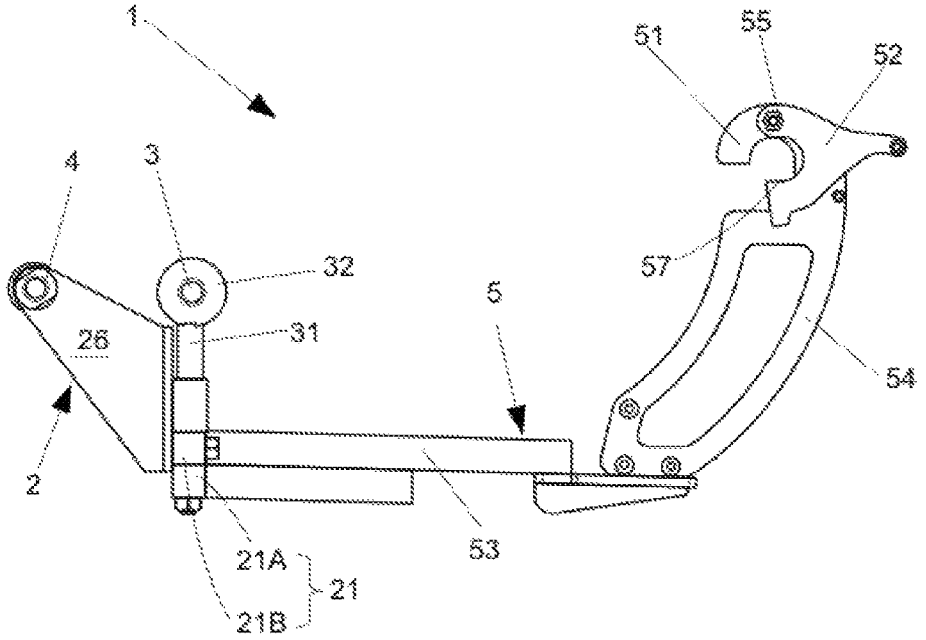
FIG. 3 schematically shows a side view of the auxiliary frame of FIG. 1.
Figure 4:
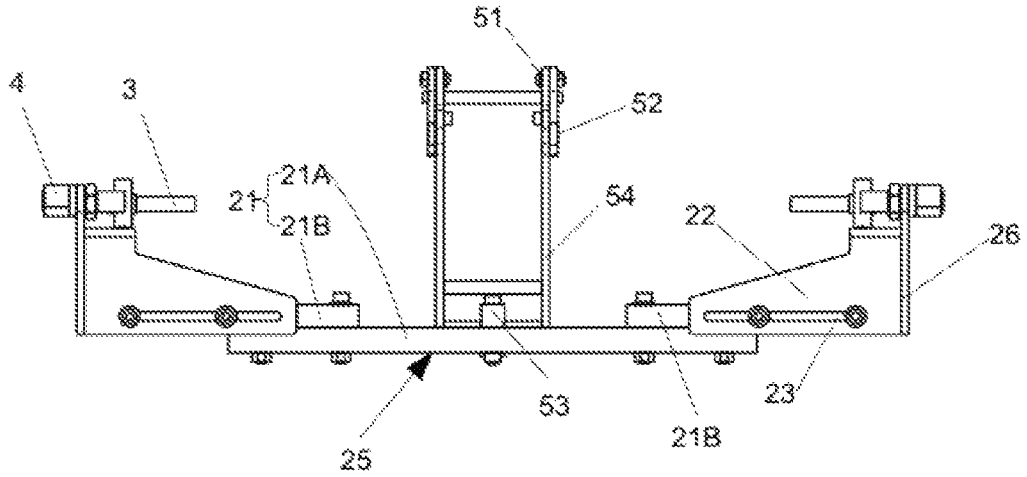
FIG. 4 schematically shows a rear view of the auxiliary frame of FIG. 1 in a different configuration.
Figure 5:
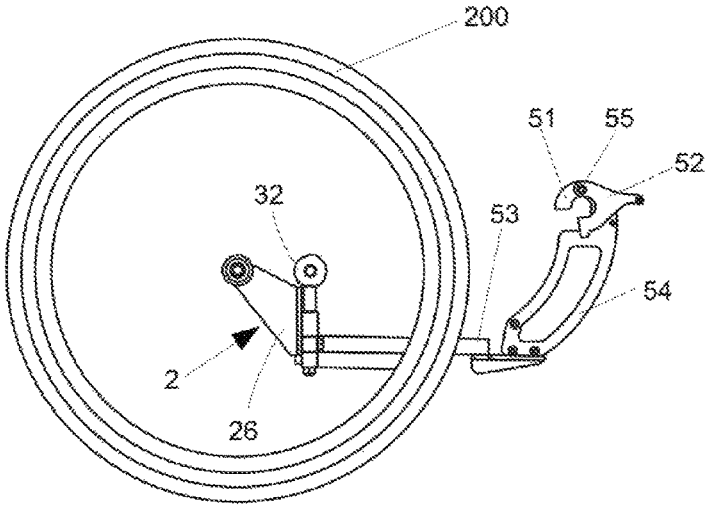
FIG. 5 schematically shows a side view of the auxiliary frame of FIG. 1 with an attached rear wheel.
Figure 6:
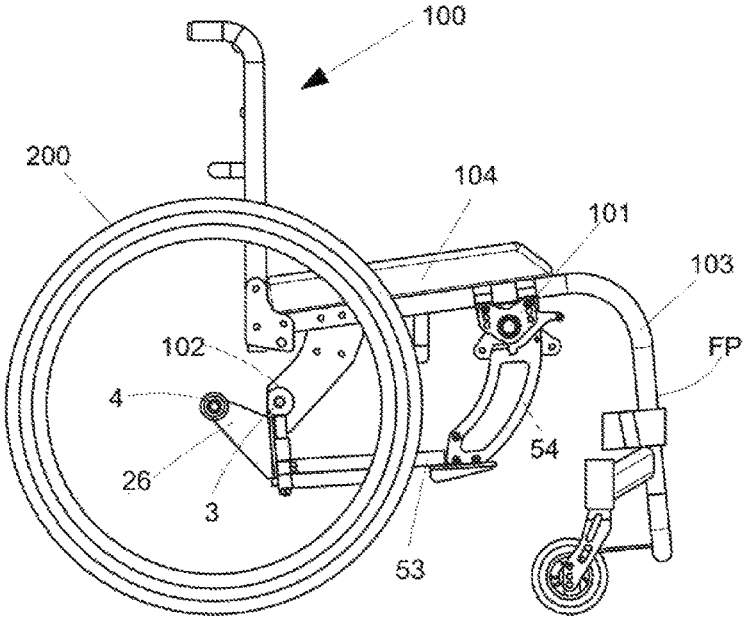
FIG. 6 schematically shows a side view of the wheelchair of the FIG. 1 with the auxiliary frame.

Beam 21 and arms 22 can be clearly seen in FIGS. 2 to 4.

By moving the arms 22 along the beam 21 the user may adjust the distance between the wheel holders 4.

An exemplary way to achieve movable arms 22 along the beam 21 may be, for instance, an auxiliary frame system 1 comprising a runner mechanism 23 provided between the beam 21 and each arm 22. This example is shown in FIGS. 1, 2 and 4.

In some examples, each arm 22 may comprise a flange 26 where the wheel holder 4 is provided. As can be seen in FIGS. 1-6, the flange 26 extends in the direction of movement DM, which is substantially perpendicular to the beam 21. Alternatively, the flange 26 could be arranged substantially slanted or even parallel to the beam 21. The arm 22 with the flange 26 may be "L"-shaped when seen from above.

The illustrated flange 26 allows obtaining a shifted rear wheel axis SA displaced with respect the main rear wheel axis MA in the direction of movement DM. Furthermore, the construction allows a good load distribution and strength.

The flange 26 may have a laminar body, for example with a substantially triangular outline as shown in FIG. 3, but the shape and the configuration of the flange 26 may vary depending on particular requirements.

In the illustrated examples, the crossbar 25 may comprise various portions of beam 21. In FIG. 4, a portion of beam 21A is attached to a pair of portions of beam 21B. Portions 21B may be attached to the portion 21A in different relative positions to further adjust the distance between the wheel holders 4.

Portion 21B may be displaced along portion 21A following opposite directions so as to widen or shorten the overall length of the crossbar 25. For example, in FIG. 4 the portions 21B have a different position with respect to the portion 21A than the relative position in FIG. 2.

Alternatively, the crossbar 25 may comprise a single beam 21.

In an additional example, as the one illustrated in FIG. 3, the auxiliary frame system 1 may comprise a support 31 which connects the beam 21 with each of the fastening elements 3. This way, the crossbar 25 may be positioned farther away from the seat 104 and may generate a bigger gap to house any part of the chair under the seat 104. The versatility of the auxiliary frame system 1 is even enhanced. If portion 21B may be displaced along portion 21A as above described, the distance between fastening elements 3 may be adjusted.

A tube 32 may be attached to the support 31 at one end so as to bear the corresponding fastening element 3, as shown in FIG. 3.

As can be seen in FIGS. 3 to 6, the anchoring link 5 may comprise a hook 51 at one end to be attached to a coupling bar 101 of the wheelchair frame 103. The coupling bar 101 may be an auxiliary bar or an integral part of the frame 103. The coupling bar 101 may be positioned under the seat 104 or in any other region of the chair 100. Exemplary, the coupling bar 101 may be arranged crosswise to the direction of movement DM.

The hook 51 may have a longitudinal section which matches at least partially the cross section of the coupling bar 101 so as to avoid any clearance therebetween.

The hook 51 may be replaced with any other device able to reliably and detachably join the anchoring link 5 to the frame 103, such as jaws, clamps, or the like.

As can be seen in FIGS. 2 to 6, the hook 51 may comprise a latch 52 to enclose, at least partially, the coupling bar 101 to releasably secure the hook 51. This latch 52 may also show a longitudinal section matching the cross section of the coupling bar 101, at least partially. Thus the latch 52 may comprise a rounded portion; the latch 52 may rotate around a pivot joint 55 to lock the hook 51.

The latch 52 may have a flattened section 57 (see FIG. 3) at the end of the rounded portion to abut and press the coupling bar 101 and keep the latch fixed to the coupling bar 101.

In further examples, the anchoring link 5 may comprise a bar portion 53 which can be attached to the crossbar 25 in different positions to adjust the distance between the hook 51 of the anchoring link 5 and the fastening elements 3. Thus the anchoring link 5 may be expandable and retractable. This expansion or retraction may be achieved in different ways: for instance through a telescopic construction or two or more portions slidably connected to each other along the direction of movement DM or two or more portions connected to each other by fasteners.

In the example illustrated in FIGS. 1, 3, 5 and 6, the bar portion 53 is associated with the hook 51 through an arched portion 54. This arched portion 54 may be integrally formed with the hook 51 and/or with the bar portion 53.

The hook 51 and even the arched portion 54 may comprise two parallel laminar bodies (see FIGS. 1 and 2) at a distance from each other and joined together to provide a robust and reliable anchoring of the auxiliary frame 1 to the frame 103, for example at two spaced-apart points along the coupling bar 101.

According to non-illustrated examples, the auxiliary frame 1 may further comprise a power unit (not shown) connectable to the rear wheels 200, so as to drive the rear wheels. This power unit may be housed over the anchoring link 5 or attached to the crossbar 25, for example.

Alternatively, each wheel 200 may be associated with a respective power unit.

The auxiliary frame system 1 may further comprise a differential (not illustrated) operatively connected to the power unit and connectable to the rear wheels 200 to deliver power to the wheels 200.

In some examples such as the one illustrated in FIG. 1, a wheelchair 100 may comprise an auxiliary frame system 1 as herein disclosed, wherein the shifted rear wheel axis SA defined between the wheel holders 4 of the auxiliary frame system 1 is further away from a front part FP of the wheelchair than the main rear wheel axis MA of the frame 103.

With the auxiliary frame system 1 operatively connected to the frame 103 the shifted rear wheel axis SA is thus positioned backwards from the main rear wheel axis MA in the direction of movement DM, so a longer wheelbase may be achieved. A longer wheelbase may enhance the stability of the wheelchair 100, which may be particularly useful especially at relatively high speeds.

That wheelbase may be defined in some cases as a distance between the main rear wheel axis MA or shifted rear wheel axis SA and an axis of rotation of the wheel of the hand-bike.

In further examples of the wheelchair 100, the shape of the anchoring link 5 allows an space S to be defined between the auxiliary frame system 1 and a seat 104 of the wheelchair 100. The space S defined by the gap under the seat 104 may be configured to allow some parts of the wheelchair 100 to be received therein.

If the auxiliary frame system 1 comprising a power unit is attached to a wheelchair provided with a motorized hand-bike, a common control may manage the operation of the power unit of the auxiliary frame 1 and the motorized hand-bike so as to achieve a coordinated operation of the wheelchair 100 transformed into a motorized tricycle. The user does not need to manage both power units separately.

FIG. 7 schematically shows a side view of a wheelchair 100 with the auxiliary frame system 1 according to another example. Here the attachment point AP is exemplary arranged at the frame 103, particularly the region of the seat 104. In this case the attachment point AP is positioned slightly forwards from the opening 102 or the main rear wheel axis MA. The anchoring link 5 is connected with the wheel displacement element 2 at one end opposite to the attachment point AP. In this example the auxiliary frame system 1 comprises at least one attachment point AP, one anchoring link 5 and one wheel displacement element 2 at each side of the wheelchair 100 (with respect to the direction of movement DM).

FIG. 8 schematically shows a side view of a wheelchair 100 with the auxiliary frame system 1 according to a further example. The attachment point AP is arranged at the frame 103 but unlike the example illustrated in FIG. 7, the attachment point AP is arranged particularly at the boundary region between the seat 104 and the backrest element 105. The anchoring link 5 is associated with the wheel displacement element 2, particularly at an intermediate region of the wheel displacement element 2, between the end intended for attachment to the opening 102 and the end intended to carry the wheel holder 4. Therefore, the anchoring link 5 may be placed backwards from the main rear wheel axis MA. As mentioned in relation with the example of FIG. 7, some components such as the anchoring link 5, a displacement element 2 and an attachment point AP may be provided at each side of the wheelchair 100 (with respect to the direction of movement DM).

The anchoring link 5 may comprise a suspension element 56 to dampen oscillations so as to achieve a comfortable operation. This suspension element may be a resilient element, a damper or the like. The wheel displacement element 2 may rotate about the opening 102 when the wheelchair is in operation, so the suspension element 56 may dampen the oscillations generated. This example can be seen in FIG. 8.

In the examples illustrated in FIGS. 1-6, the suspension element may be positioned between the crossbar 25 and the fastening element 3.

In some alternative examples which are not illustrated, the auxiliary frame system 1 may be integrally fixed once mounted to the frame 103.

FIG. 11 schematically shows a side view of a wheelchair 100 with an auxiliary frame system 1 arranged according to various examples. In this FIG. 11, although a number of anchoring links 5 has been illustrated, they are merely some possible examples of positions that can be adopted by the anchoring link 5. By way of example, the attachment point AP may be placed at the region of the front part FP, the seat 104, plate 107 of the frame 103 or even the backrest element 105.

In the following, an example of a method to displace the position of rear wheels 200 of a wheelchair 100 will be explained. This exemplary method comprises:

removing rear wheels 200 from the frame 103 of the wheelchair. FIG. 9 schematically shows a side view of a wheelchair 100, without the auxiliary frame system 1, wherein the rear wheels 200 are set in their normal position on the main rear wheel axis MA. Starting from a wheelchair 100 as that one illustrated in FIG. 9, rear wheels 200 may be popped-off at both sides of the wheelchair 100 with respect to the direction of movement DM. Depending on the particular configuration of the wheelchair 100 removing the rear wheels 200 may also imply releasing axle portions of the rear wheels 200. If the wheelchair 100 comprises quick-release axles or the like, then no tool is required to pop-off the rear wheels 200;

attaching an auxiliary frame system 1, according to any of herein disclosed examples, to the frame 103 of the wheelchair. The auxiliary frame system 1 may be coupled to the frame 103 as illustrated in FIG. 1, 2, 6, 7, 8 or 11. In the examples of FIGS. 1-6, in order to adapt the auxiliary frame system 1, the arms 22 may be moved along the beam 21 and the bar portion 53 may be expanded or retracted to suitably adjust the size of the auxiliary frame system 1. Portions 21B of crossbar 25 may be moved with respect to portion 21A so as to further widen the distance between the wheel holders 4. The latch 52 is engaged to secure the coupling between the hook 51 and the coupling bar 101;

mounting rear wheels 200 to the auxiliary frame system 1. FIG. 10 schematically shows a side view of a wheelchair 100 where the auxiliary frame system 1 has been illustrated only very schematically in dotted lines for the sake of clarity, indicating the position of a fastening element 3 and of a wheel holder 4. In this FIG. 10 rear wheels 200 are mounted on a shifted rear wheel axis SA because they have been mounted to the wheel holders 4 of the auxiliary frame 1 (see FIGS. 5 and 10); these rear wheels may be the same ones as those equipped in the wheelchair 100, so the user does not need to have several pairs of rear wheels 200, or different wheels, e.g. adapted to certain terrains or conditions. As above mentioned, the wheel holder 4 may comprise a quick-release mechanism such as an axle portion to bear the wheels 200.

Alternatively, the rear wheel 200 may be mounted to the auxiliary frame system 1 before attaching the auxiliary frame system 1 to the frame 103.

In some examples of the method, attaching the auxiliary frame system 1 to the frame of the wheelchair may comprise:

attaching the wheel displacement elements 2 of the auxiliary frame system to the frame 103 of the wheelchair through openings 102 of the frame 103 of the wheelchair. The fastening elements 3 may be inserted into the openings 102 from both ends of the openings 102, i.e. the wheel displacement elements 2 may remain substantially inside a region defined between the two openings 102, or substantially outside this region. In the examples of FIGS. 1-6, the fastening elements 3 of the two displacement elements 2 may be simultaneously attached to the corresponding openings 102. This operation may be carried out simultaneously because the wheel displacement elements 2 are associated through the crossbar 25. In these examples the auxiliary frame system 1 may be configured as an integral piece. In the examples of FIGS. 7, 8 and 11, each of the wheel displacement elements 2 may be attached to the frame 103 separately from each other. This separated attaching operation may be carried out because those examples do not comprise the crossbar 25. In these examples the auxiliary frame system 1 may be configured as two independent halves positionable respectively at each side of the wheelchair 100;

securing the wheel displacement elements 2 to the frame 103 of the wheelchair at an additional attachment point AP. This additional point may be defined by the contact area between the anchoring link 5 and the coupling bar 101 of the wheelchair 100 in the examples of FIGS. 1-6 or any suitable region of the frame 103 as above mentioned in relation with FIG. 11.

The position of rear wheels 200 may be displaced from an original position when they are mounted on the frame 103 through the openings 102 (see FIG. 9) to a shifted position when they are mounted on the auxiliary frame system 1 (see FIG. 10). In the shifted position the shifted rear wheel axis SA may be offset backwards, and/or the distance between the wheel holders 3 may be greater than the distance between the openings 102.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

What is claimed is:

1. An auxiliary frame system for a wheelchair, the wheelchair having a frame comprising two openings to releasably attach axle portions of rear wheels and defining between them a main rear wheel axis; wherein the auxiliary frame system comprises:

a pair of wheel displacing elements;

fastening elements to releasably attach each wheel displacing element to the frame of the wheelchair through the openings;

wheel holders for bearing respective rear wheels of the wheelchair, wherein each of the wheel holders is associated with a respective wheel displacing element, and the wheel holders define a shifted rear wheel axis between them;

at least one anchoring link to releasably secure at least one of the wheel displacing elements to the frame of the wheelchair at an additional attachment point.

2. The auxiliary frame system according to claim 1, further comprising two anchoring links to releasably secure each of the wheel displacing elements to the frame of the wheelchair at respective additional attachment point.

3. The auxiliary frame system according to claim 1, further comprising:

a crossbar to associate the wheel displacing elements with each other;

wherein the anchoring link is connected to the crossbar so as to releasably secure the wheel displacing elements to the frame of the wheelchair at the additional attachment point.

4. The auxiliary frame system according to claim 3, wherein the crossbar comprises a beam and the wheel displacing elements comprise a pair of arms attached to the beam in such a way that the arms are movable along the beam.

5. The auxiliary frame system according to claim 4, further comprising a runner mechanism provided between the beam and the arms to adjust the distance between the wheel holders.

6. The auxiliary frame system according to claim 4, further comprising a support which connects the beam with each of the fastening elements.

7. The auxiliary frame system according to claim 3, wherein the anchoring link comprises a hook at one end to be attached to a coupling bar of the wheelchair frame.

8. The auxiliary frame system according to claim 7, wherein the hook comprises a latch to enclose at least partially the coupling bar so as to releasably secure the hook.

9. The auxiliary frame system according to claim 7, wherein the anchoring link comprises a bar portion which can be attached to the crossbar at different positions to adjust the distance between the hook and the fastening elements.

10. The auxiliary frame system according to claim 1, wherein at least one of the wheel holders and the fastening elements comprise a quick-release mechanism.

11. The auxiliary frame system according to claim 1, wherein the anchoring link comprises a suspension element to dampen oscillations.

12. A wheelchair comprising an auxiliary frame system, the wheelchair having a frame comprising two openings to releasably attach axle portions of rear wheels and defining between them a main rear wheel axis; wherein the auxiliary frame system comprises:

a pair of wheel displacing elements;

fastening elements to releasably attach each wheel displacing element to the frame of the wheelchair through the openings;

wheel holders for bearing respective rear wheels of the wheelchair, wherein each of the wheel holders is associated with a respective wheel displacing element, and the wheel holders define a shifted rear wheel axis between them;

at least one anchoring link to releasably secure at least one of the wheel displacing elements to the frame of the wheelchair at an additional attachment point;

wherein the shifted rear wheel axis defined between the wheel holders of the auxiliary frame system is further away from a front part of the wheelchair than the main rear wheel axis of the frame.

13. The wheelchair according to claim 12, wherein the shape of the anchoring link allows a space to be defined between the auxiliary frame system and a seat of the wheelchair.

14. A method to displace the position of rear wheels of a wheelchair, which comprises:

removing rear wheels from a frame of the wheelchair;

attaching an auxiliary frame system to the frame of the wheelchair, the wheelchair having a frame comprising two openings to releasably attach axle portions of rear wheels and defining between them a main rear wheel axis; wherein the auxiliary frame system comprises:

a pair of wheel displacing elements;

fastening elements to releasably attach each wheel displacing element to the frame of the wheelchair through the openings;

wheel holders for bearing respective rear wheels of the wheelchair, wherein each of the wheel holders is associated with a respective wheel displacing element, and the wheel holders define a shifted rear wheel axis between them;

at least one anchoring link to releasably secure at least one of the wheel displacing elements to the frame of the wheelchair at an additional attachment point;

the method further comprising mounting rear wheels to the auxiliary frame system.

15. The method according to claim 14, wherein attaching the auxiliary frame system to the frame of the wheelchair comprises:

attaching wheel displacing elements of the auxiliary frame system to the frame of the wheelchair through openings of the frame of the wheelchair;

securing the wheel displacing elements to the frame of the wheelchair at an additional attachment point.

* * * * *